US009243460B2

(12) United States Patent
Wollmann

(10) Patent No.: US 9,243,460 B2
(45) Date of Patent: Jan. 26, 2016

(54) ROD CLAMPING DEVICES FOR HANGING OR PULLING ROD STRINGS IN A WELLBORE

(71) Applicant: Arnold Wollmann, Lloydminster (CA)

(72) Inventor: Arnold Wollmann, Lloydminster (CA)

( * ) Notice: Subject to any disclaimer, the term of this patent is extended or adjusted under 35 U.S.C. 154(b) by 555 days.

(21) Appl. No.: 13/660,590

(22) Filed: Oct. 25, 2012

(65) Prior Publication Data

US 2013/0101380 A1 Apr. 25, 2013

Related U.S. Application Data

(60) Provisional application No. 61/551,123, filed on Oct. 25, 2011.

(51) Int. Cl.

| | |
|---|---|
| ***E21B 19/10*** | (2006.01) |
| ***B66C 1/42*** | (2006.01) |
| ***E21B 19/12*** | (2006.01) |

(52) U.S. Cl.

CPC . *E21B 19/10* (2013.01); *B66C 1/42* (2013.01); *E21B 19/12* (2013.01)

(58) Field of Classification Search

CPC ..... E21B 19/02; E21B 19/07; E21B 19/10; E21B 19/16; E21B 19/161–19/164; E21B 33/0422; B66C 1/42

USPC ..... 166/77.53; 175/423

See application file for complete search history.

(56) References Cited

U.S. PATENT DOCUMENTS

| | | | | | |
|---|---|---|---|---|---|
| 1,343,426 | A | * | 6/1920 | Wright | 166/85.1 |
| 1,637,270 | A | * | 7/1927 | Neely | 294/90 |
| 1,684,974 | A | | 9/1928 | Shaffer | |
| 1,721,024 | A | * | 7/1929 | Krell et al. | 294/102.2 |
| 1,758,108 | A | * | 5/1930 | Goeser | 175/423 |
| 1,836,596 | A | * | 12/1931 | Hoffoss et al. | 175/423 |
| 1,878,372 | A | * | 9/1932 | Box | 175/423 |
| 2,117,783 | A | * | 5/1938 | Herbert | 175/423 |
| 2,135,070 | A | * | 11/1938 | Fisher | 175/423 |
| 2,153,770 | A | * | 4/1939 | Nixon | 175/423 |
| 2,260,876 | A | | 10/1941 | Wagner | |
| 4,275,487 | A | * | 6/1981 | Gray et al. | 188/67 |
| 4,887,673 | A | * | 12/1989 | Skoruppa | 166/382 |
| 4,936,382 | A | * | 6/1990 | Thomas | E21B 33/0422 166/88.2 |
| 2002/0162665 | A1 | * | 11/2002 | Adams et al. | 166/382 |
| 2009/0056930 | A1 | * | 3/2009 | Angelle | E21B 19/07 166/77.51 |

* cited by examiner

*Primary Examiner* — Blake Michener

(74) *Attorney, Agent, or Firm* — Kyle R. Satterthwaite; Ryan W. Dupuis; Ade + Company Inc

(57) ABSTRACT

Clamping devices for hanging or pulling wellbore rod strings each feature housing with an axial bore in which a number of clamping pieces are placed to wedge in place between the housing and rod string to perform a self-tightening action against the rod string under the weight thereof due to cooperation of beveled surfaces at the bore wall and exterior of the clamping pieces. Threaded fasteners fed through the housing wall aid in placement of the slips against the rod string. For use in pulling operations, the housing is sized for receipt in the latching mechanism of a tubing elevator for support by the same, whereby the tubing elevator can be used to pull out a stuck rod string. Some embodiments feature a circumferential gap in the housing to enable the housing to be slipped laterally onto the rod string.

20 Claims, 5 Drawing Sheets

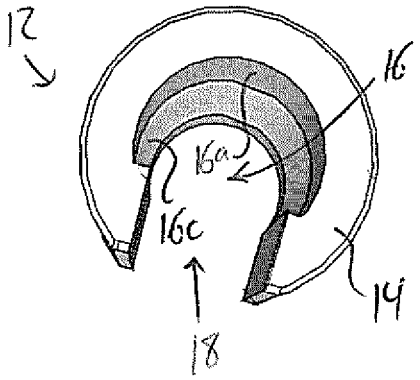
FIG. 5
FIG. 6
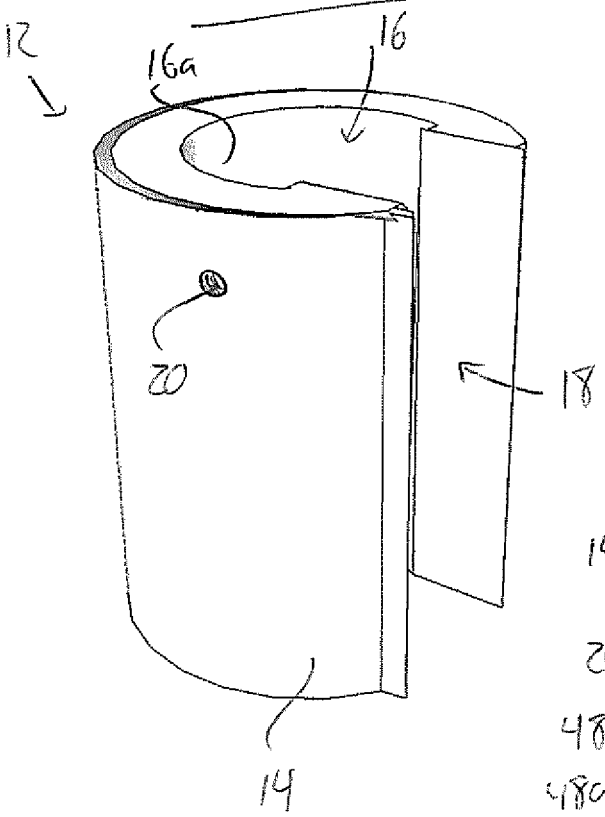
FIG. 7
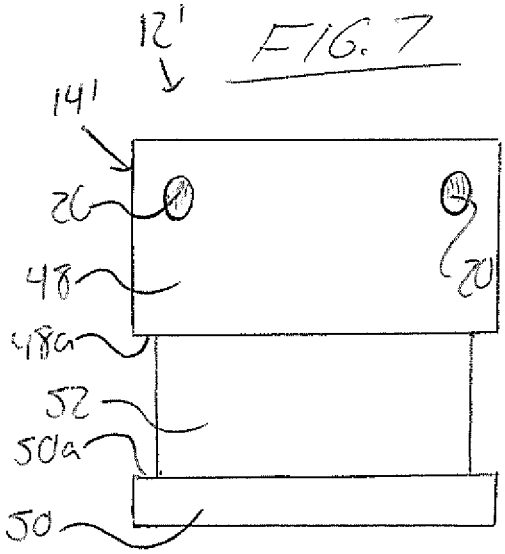

ROD CLAMPING DEVICES FOR HANGING OR PULLING ROD STRINGS IN A WELLBORE

CROSS REFERENCE TO RELATED APPLICATIONS

This application claims benefit under 35 U.S.C. 119(e) of U.S. Provisional Patent Application Ser. No. 61/551,123, filed Oct. 25, 2011.

FIELD OF THE INVENTION

The present invention relates to clamping devices for gripping a string of rods at a surface location above the wellbore into which the rod string depends, for example for the purpose of hanging the string from the device during removal of an uppermost rod to dismantle the string being pulled from the wellbore, or for use of the device on a tubular elevator for pulling out a string that has become stuck in the wellbore.

BACKGROUND OF THE INVENTION

In the oil and gas industry, it is well known to use slip mechanisms to suspend a string of tubular members (i.e. wellbore casing or production tubing) in a wellbore. Such mechanisms employ a bowl-shaped housing having an axial passage defined there through with a tapered passage wall that narrows toward the lower opening of the passage at the bottom of the bowl. Clamping pieces, called slips, have arcuately shaped inner surfaces sharing a radius of curvature equal or close to the outer circumference of the tubular members of the string to be suspended, and have obliquely sloped outer surfaces tapered at the same angle as the interior passage wall of the bowl. Positioned around the tubular member in the annular space between the tubular member and the bowl wall, the slips gravitationally slide down the wall of the bowl, and the cooperation of the tapered or beveled surfaces acts to direct the slips radially inward toward the central axis of the passage as they fall, thereby encouraging the inner surfaces of the slips against the tubular member. Frictionally engaged against the tubular member in this manner, the weight of the tubular string pulls further down on the slips, with the sloped wall of the bowl thereby further tightening the slips against the tubular member. The tapered wall of the bowl prevents the slips, and thus the tubular member gripped therebetween, from sliding through the open bottom of the bowl, thereby suspending the tubular string from the bowl. As the weight of the slips and the tubular string acts to wedge the slips tighter against the string, the clamping action occurs automatically under the weight of the slips and tubular string.

Due to the significant weight of long tubular strings, the mechanism is typically of a robust design having large, heavy slip pieces, and so the slips are typically coupled to powered actuators of some kind to raise the slips out of the tubular-gripping position when axial movement of the tubular string through the bole is required. However, there are also older patents relating to tools for manually manipulating slips for a tubing or rod string, such as those disclosed in U.S. Pat. Nos. 1,684,974 and 2,260,876.

The applicant has developed new clamping devices sized for use with solid rods, as opposed to larger hollow tubulars, that may employ slip-type arrangements using beveled surfaces to automatically encourage the gripping of the rod, but that additionally are configured to allow use of differently sized slips or clamping pieces for different rod sizes without having to switch to a differently sized housing, and are configured for mounting on a tubing elevator to adapt the same for gripping of rods of lesser diameter than the tubing or casing for which the elevator was intended.

SUMMARY OF THE INVENTION

According to a first aspect of the invention there is provided a rod clamping device for suspending a rod within a wellbore from a surface position above said wellbore, the device comprising:

an outer housing having an axial passageway extending therethrough along a primary longitudinal axis, the housing comprising a wall structure extending circumferentially about the longitudinal axis but spanning less than fully therearound to leave a gap for accessing the axial passageway from outside the wall structure;

a plurality of clamping pieces each comprising a clamping portion having an arcuately contoured inner face curving about a respective secondary longitudinal axis, the arcuately contoured inner faces of the clamping pieces being configured with the same arcuate contour about the respective secondary longitudinal axes so that coincident positioning of said respective secondary longitudinal axes with one another positions the arcuately contoured inner faces of the clamping pieces on a shared circular path around said coincident axes and positions the clamping portions of the clamping pieces in a configuration sized to fit within the axial passageway of the outer housing;

a plurality of clamping actuators each operable on the outer housing to move a working end of the clamping actuator toward the primary longitudinal axis so as to force a respective one of the clamping pieces toward the primary longitudinal axis of the axial passageway of the housing when the clamping portions of the clamping pieces are received therein; and stop features associated with the outer housing and the plurality of clamping pieces to block sliding of the clamping pieces fully through a lower end of the axial passageway of the housing.

Through this arrangement, the rod is receivable within the axial passageway of the housing via the gap in the wall structure and the clamping pieces are driveable toward the rod by the clamping actuators to clamp the clamping pieces against circumferential surfaces of the rod so that engagement of the stop features with one another to support the clamping pieces also acts to suspend the rod from the housing.

The stop features may comprise externally beveled portions of the clamping pieces and an internally beveled portion of the axial passage, the externally beveled portions of the clamping pieces and the internally beveled portion of the housing being beveled at equal angles.

The stop features may also or alternatively comprise external shoulders projecting outward from the clamping pieces to rest atop the housing at positions around the axial passageway therein.

Preferably there is provided a pivotal connection respectively defined between at least one pair of adjacent clamping pieces, each pivotal connection defining a pivot axis oriented transverse to the secondary longitudinal axes of said respective pair of clamping pieces.

Preferably there are provided three of said clamping pieces, each of said three clamping pieces being connected to the two other clamping pieces by a respective one of said pivotal connection.

Preferably the clamping actuators comprise threaded members engaged in threaded bores extending through the wall structure of the housing.

Preferably the threaded members comprise drive heads engagable by an external tool separate from the clamping device at locations outside the housing.

Preferably the housing comprises a lower base defining a greater outer radius of said housing from the primary longitudinal axis at a bottom end thereof than above said base.

Preferably the housing comprises a shouldered upper portion of greater outer radius from the primary longitudinal axis than an intermediate portion of the housing disposed below the shouldered upper portion.

The intermediate portion of the housing may be sized for latched receipt thereof in a tubing elevator.

The housing may comprise a flat bottom for seating the housing atop a support structure situated over the wellbore.

The clamping pieces are preferably separate from the housing for manual placement in the axial passage of the housing after placement of the housing around the rod.

Preferably there are provided multiple sets of said clamping pieces, each set being differently sized to engage rods of a respective diameter.

According to a second aspect of the invention there is provided a method of using the clamping device of the first aspect of the invention to support a rod string depending into the wellbore through a structure disposed thereover, the method comprising the following steps:

(a) with the rod string carried by supporting means other than the clamping device, displacing the housing toward the rod string to receive the rod string within the axial passageway of the housing through the gap in the wall structure thereof to seat the housing on the structure in a position extending about the rod string;

(b) placing the clamping pieces within the axial passageway of the housing in an annular space left between the rod string and the wall structure of the housing with the arcuately contoured inner faces of the clamping pieces facing toward the rod string; and (c) operating the clamping actuators to drive the working ends against the clamping pieces to urge the clamping pieces into clamped conditions against the rod string; and (d) engaging together the stop features of the housing and the clamping pieces to seat the clamping pieces on the housing to suspend the rod string therefrom.

The method preferably further comprises step (e) of releasing the other supporting means from the rod string, removing an uppermost rod from the string, engaging the other supporting means to the rod string at a location below where the uppermost rod was removed and above the clamping pieces, loosening the clamping action of the clamping pieces on said other rod, lifting the rod string using the other supporting means, and repeating steps (c) through (e) to continue dismantling the rod string.

According to a third aspect of the invention there is provided an auxiliary clamping device for pulling rods from a wellbore with a tubing elevator, said clamping device comprising:

an outer housing having an axial passageway extending therethrough along a primary longitudinal axis, the housing comprising a wall structure extending about the primary longitudinal axis to span at least a majority of a circumferential path around said longitudinal axis, the outer housing having an outer diameter sized for latched engagement thereof by the tubing elevator;

a plurality of clamping pieces each comprising a clamping portion having an arcuately contoured inner face curving about a respective secondary longitudinal axis, the arcuately contoured inner faces of the clamping pieces being configured with the same arcuate contour about the respective secondary longitudinal axes so that coincident positioning of said respective secondary longitudinal axes with one another positions the arcuately contoured inner faces of the clamping pieces on a shared circular path around said coincident axes and positions the clamping portions of the clamping pieces in a configuration sized to fit within the axial passageway of the outer housing;

a mechanism operable to displace the clamping pieces toward the longitudinal axis of the axial passage of the housing when said clamping pieces are received therein; and a first set stop features associated with the outer housing and the plurality of clamping pieces and arranged to block sliding of the clamping pieces fully through a lower end of the axial passageway of the housing; and a second stop feature provided on the outer housing and arranged to retain the outer housing in the latched engagement by the tubing elevator.

Preferably the second stop feature comprises a shouldered upper portion of greater radial outer radius from the primary longitudinal axis than an intermediate portion of the housing disposed below the shouldered upper portion, whereby the shouldered upper portion is arranged to rest on a portion of the elevator that closes around and grips the intermediate portion, thereby blocking sliding of the housing downward through the tubing elevator.

Preferably the housing also comprises a shouldered lower portion defining a greater outer radius from the primary longitudinal axis at a bottom end thereof than defined by said housing just above said shouldered lower portion, whereby the shouldered upper portion is arranged to catch under a portion of the elevator that closes around and grips the intermediate portion, thereby blocking sliding of the housing upward through the tubing elevator.

The clamping pieces may have beveled outer surfaces cooperable with beveled inner surfaces of the wall structure of the housing to automatically bias the clamping pieces toward the primary longitudinal axis of the axial passageway of the housing when received therein.

According to a fourth aspect of the invention there is provided a method of using the clamping device of the third aspect of the invention to pull a rod string, the method comprising the steps of:

situating the housing in a condition in which a rod of the rod string passes through the axial passageway of the housing and the elevator is latched around the housing;

with the clamping pieces positioned in an annular space between the rod and the wall structure of the housing, clamping the clamping pieces against the rod, and engaging together the first step of stop features between the housing and the clamping pieces to seat the clamping pieces on the housing to suspend the rod string therefrom; and using the elevator to raise the housing, thereby pulling the clamped-together rod and clamping pieces to pull the rod string.

BRIEF DESCRIPTION OF THE DRAWINGS

In the accompanying drawings, which illustrate exemplary embodiments of the present invention:

FIG. 5 is a perspective view of a housing of a clamping device like that of FIG. 1, as viewed from above.

FIG. 6 is a perspective view of the housing of FIG. 5 from a side thereof.

FIG. 7 is an elevational view of a housing of a second embodiment clamping device.

DETAILED DESCRIPTION

Figure 1:
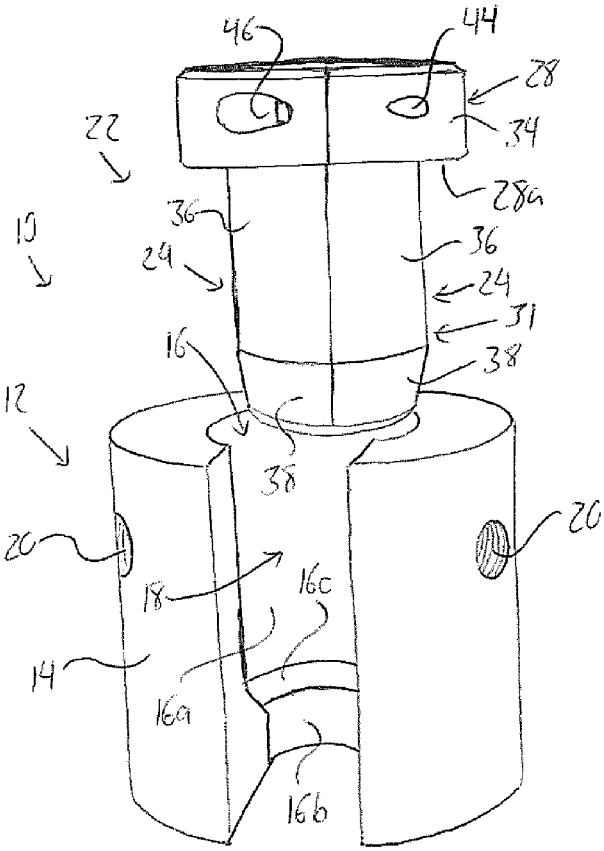
FIG. 1 is a perspective view of a clamping device according to a first embodiment of the present invention.
Figure 3:
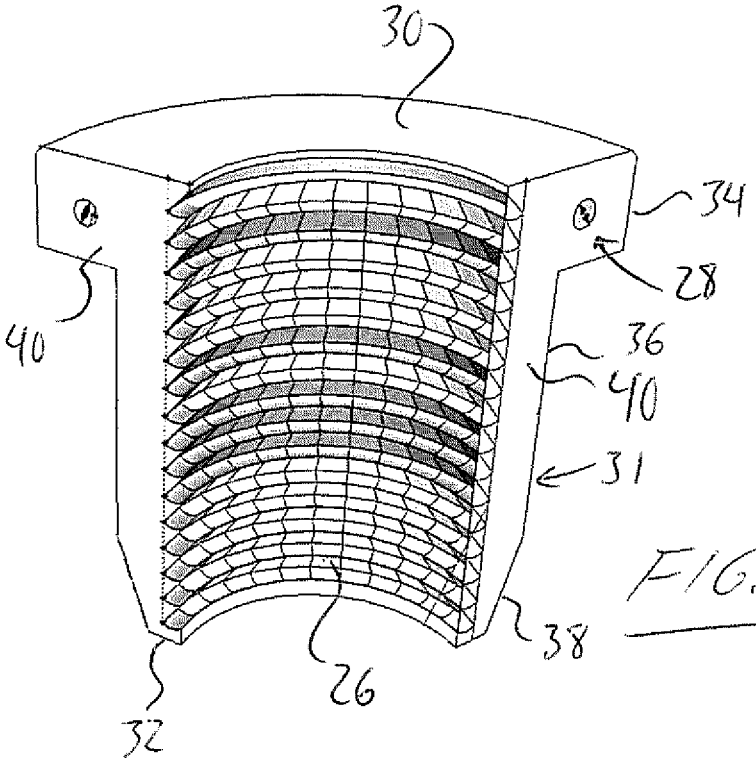
FIG. 3 is an isolated perspective view of the one of the clamping pieces of FIG. 2 from an inner side thereof.
Figure 4:
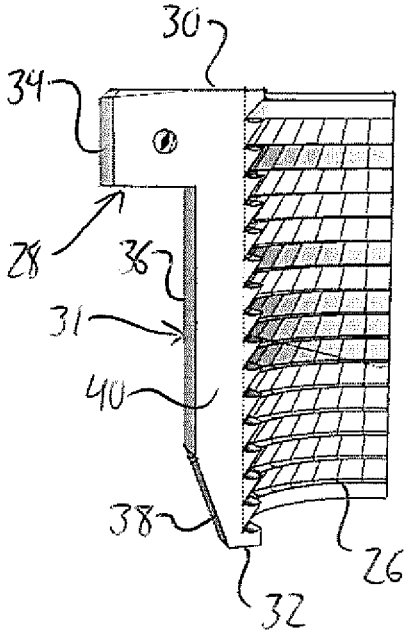
FIG. 4 is an elevational view of the clamping piece of FIG. 3 from the inner side thereof.

FIG. 1 shows a first embodiment clamping device 10 of the present invention, useful for suspending a string of rods in a wellbore, for example when pulling the string from the wellbore and dismantling the string by removal of the uppermost rod one at a time as the string is pulled up out of the wellbore. In such a process, the clamping device can be used on the second uppermost rod in the string to suspend the remainder of the string therebelow while the uppermost rod is being removed.

The device 10 features a housing 12 in the form of a c-shaped circumferential wall 14 closing less than a full circumference around an axial through-bore 16 to leave a gap 18 between opposing ends of the wall 14. The through-bore 16 is centrally located so as to be concentric with the arcuate curvature of the surrounding wall 14. The boundary wall of the through-bore 16, as defined by the inner surface of the circumferential wall 14, features a cylindrical upper portion 16*a* intersecting the flat top of the housing, a cylindrical lower portion 16*b* of smaller diameter than the upper portion intersecting the flat bottom of the housing, and a beveled intermediate portion 16*c* that frustoconically tapers from the larger upper portion to the smaller lower portion. At the upper portion 16*a* of the bore, at an intermediate axial distance between the intermediate portion 16*c* of the bore and the flat top of the housing, three threaded bores 20 (two of which are visible in the drawings) extend through the housing wall 14 at equally spaced positions around the central longitudinal axis shared by the through-bore and the surrounding wall 14, in radial directions relative thereto.

Figure 2:
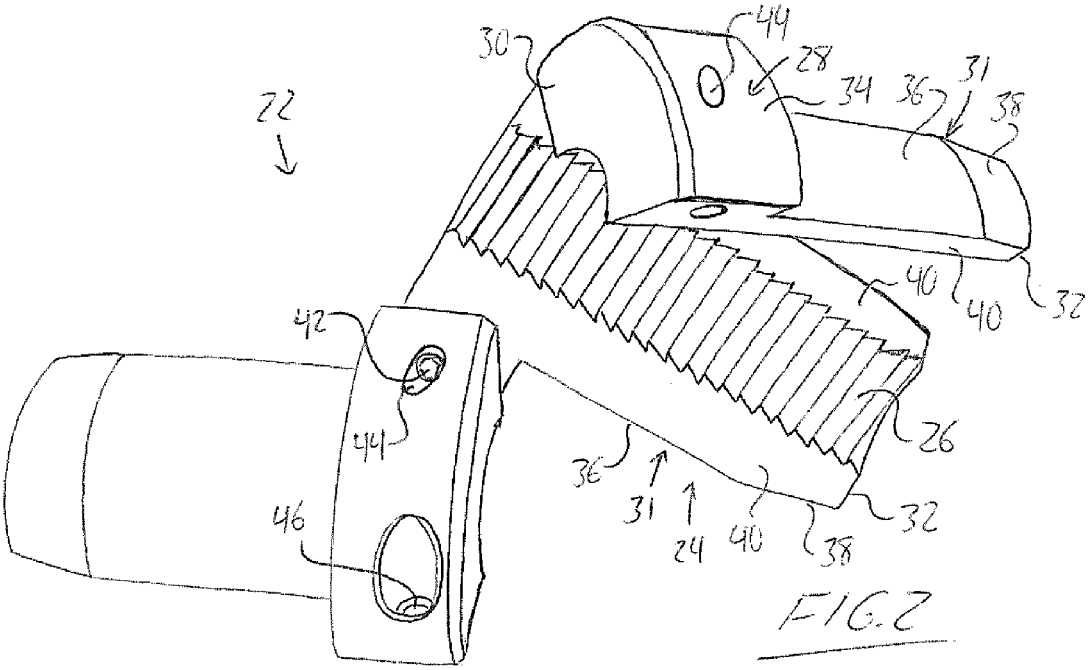
FIG. 2 is a perspective view of an assembly of clamping pieces from the device of FIG. 1, illustrating a pivotal or swiveling connection between the adjacent pieces.

A clamping assembly 22 of the device is shown in FIG. 2, and features three interconnected clamping pieces 24. Each clamping piece has an elongated shape defining a length of the piece along a respective longitudinal axis, and in cross-sectional planes normal thereto, is segment-shaped, thus having an arcuate inner surface 26 curving about the respective longitudinal axis. The arcuate inner surface has a uniform radius of curvature of the axial length of the piece. An upper portion 28 of the piece defining the top end thereof 30 is enlarged in outer radius relative to the remaining lower portion 31 that extends to the bottom end 32 of the piece. Accordingly, the upper portion 28 presents an outer surface 34 curving about the same longitudinal axis as the inner surface 26, but with a larger uniform radius of curvature. A second outer surface 36 having a uniform radius of curvature that measures somewhere between those of the inner surface and the upper outer surface 34 is defined by the lower portion 30 found immediately below the upper portion 28. A third outer surface 38 defined by the lower portion 30 extends to the bottom end 32 of the piece, and is beveled to linearly taper thereto from the second outer surface 36. The inner and outer arcuate surfaces of the piece span the same 120-degree angle, and end-faces 40 of the piece at opposite ends of its arc- or segment-shape are flat. The three clamping pieces 24 are identical, and so the planar end faces 36 of each piece 24 can each abut against a respective end-face of each of the other two clamping pieces 24 in alignment therewith.

This aligned placement together the clamping pieces in a common orientation (enlarged portion up) places the longitudinal axes of the three pieces coincident with one another, and so the three segment-shaped pieces combine to form close around these coincident axes. In other words, the combined clamping pieces encircle an axial through bore delimited by their arcuate inner faces.

In this configuration, shown in FIG. 1, the enlarged upper portions, particularly the outward projecting shoulders 28*a* defined by the bottom faces thereof, form an annular shoulder projecting radially outward further than the lower portions at a position thereover around the circumference of the assembly. The round cylindrical outer shape defined by the abutted upper portions of the combined clamping pieces is of greater diameter than the upper portion 16*a* of the housing through-bore 16, while the round cylindrical outer shape of the upper part of the abutted lower portions of the combined clamping pieces is of smaller diameter than the upper portion 16*a* of the housing through-bore 16. The maximum diameter of the frustospherical outer shape of the lower parts of the abutted lower portions of the combined clamping pieces is likewise smaller than the diameter of the upper portion 16*a* of the housing through-bore 16, but larger than the diameter of the lower portion 16*b* of the housing through-bore 16.

In other words, the radius of curvature of the outer surface 34 of the enlarged upper portion 28 of each clamping piece is greater than the radius of curvature of the upper portion 16*a* of the housing through-bore 16, while the radius of curvature of the upper outer surface 36 of the lower portion 31 of each clamping piece is less than the radius of curvature of the upper portion of the housing through-bore 16. The maximum radius of curvature of the lower outer surface 38 of the lower portion 31 of each clamping pieces is less than the radius of curvature of the upper portion 16*a* of the housing through-bore 16, but greater than the radius of curvature of the lower portion 16*b* of the housing through-bore 16.

The relative dimensioning of the clamping pieces and the housing are such that the lower portions 31 of the clamping pieces can be inserted into the through-bore 16 of the housing through the upper end thereof when brought close together end-to-end in the same enlarged-end-up orientation, even if the flat end-faces 40 of the clamping pieces are not tightly abutted up directly in contact against one another, while the downward facing shoulder 28*a* of each clamping piece will not fit into the housing through-bore 16.

The radius of curvature of the inner surfaces 26 of the clamping pieces is equal or near-equal to the radius of the rod to be supported by the clamping device, and the inner surface is threaded to form ridges 28 to better bite onto or grip the circumferential surfaces of the rod. For example, the clamping pieces are preferably manufactured from a common piece of stock that is machined to form the cylindrical and frusto-conical external surfaces resulting from the abutment-together of the finished pieces, and machined to form a threaded axial through-bore at the center before cutting through the resulting annular structure into the central bore in radial directions at three locations around the axis of the through-bore. However, it may be possible to produce the pieces in another manner and use other machining processes or material treatments to improve the frictional 'bite' or grip of the inner surfaces of the resulting pieces.

The three clamping pieces 24 are interconnected in adjacent pairs by bolts 42. As best shown in FIG. 2, two holes 44, 46 are bored through the upper portion 28 of each clamping piece 24, each hole 44, 46 passing perpendicularly through a respective one of the end-faces 40 of the piece 24 between the inner and outer arcuate surfaces 26, 34 of the upper portion at a distance below the flat upper end 30 of the piece. At the arcuate outer surface 34, each hole 44, 46 is counterbored to accommodate either the head of a bolt or a corresponding nut, while preventing the bolt head or nut from passing through the smaller through-portion of the hole. In each clamping piece 24, one hole 44 is threaded for engagement with a correspondingly threaded bolt 42, while the other hole 46 has a larger counterbored hole than the other in order to accommodate the working end of a socket to rotationally engage a nut suitably threaded to engage with a bolt.

Still referring to FIG. 2, a bolt 42 threaded through the threaded hole 44 in one clamping piece 24 extends its shaft into the adjacent clamping piece via the unthreaded hole thereof, where a nut is threaded onto the free end of the bolt shaft in the counter bore of the unthreaded hole of the second clamping piece, thereby securing the two clamping pieces together at these aligned holes. The other end of the second clamping piece is likewise fastened to the third clamping piece. These bolted connections hold the three pieces together, but are not fully tightened to a point preventing relative motion therebetween. Accordingly, as shown in FIG. 2, each clamping piece 24 can be rotated about the axis of the bolt connecting it to the adjacent clamping piece, thereby pivoting or swiveling the clamping piece about an axis transverse to the longitudinal axes of these two coupled-together clamping pieces. This allows pivoting of adjacent clamping pieces relative to one another into and out of working positions, where their longitudinal axes are all parallel and their enlarged ends are all oriented upward, for use of the clamping mechanism. A third bolt for connecting the third clamping piece back to the first is either not installed until the clamping piece assembly is situated around a rod for clamping thereto, as described below, or never installed at all.

With reference to FIG. 1, to use the clamping device 10, first the housing 12 is positioned to extend about the rod string to be clamped by displacing the housing 12 laterally toward the rod string with the gap 18 opening toward the rod string until the rod string passes through the gap 18 and is received in the through-bore 16 of the housing in generally concentric alignment therewith. The housing 12 is seated in this position, for example with the flat bottom of the housing seated on a rotary table or other suitable support surface over the well-bore, and remains here until the clamp is no longer needed. The clamping pieces 24 are then installed by swiveling one or two of the three interconnected clamping pieces relative to the adjacent clamping piece so as to open up access to the arcuate inner surface 26 of the adjacent clamping piece, which is then placed against the circumference of the rod at a position above the housing 12 with the enlarged end of the clamping piece oriented upward. The other clamping piece(s) is/are then manually or gravitationally pivoted about the connection (s) to the piece placed against the rod, thereby bringing all three of the clamping pieces into position around the rod with their arcuate inner faces directed theretoward. The assembled clamping pieces are then lowered along the rod to bring the lower portions of the clamping pieces 24 into the through-bore 16 of the housing 12 through the upper end thereof, i.e. into the annular space between the rod and the surrounding housing wall.

This lowering of the clamping pieces into the housing positions the upper outer surface 36 of the lower portion of each clamping piece in front of the inner end of a respective one of the threaded radial bores 20 of the housing. Care is taken so as not to align the seam or gap between any two of the clamping pieces with one of the bolt holes, instead selecting a rotational position of the assembled clamping pieces around the rod that will place an intermediate portion of the upper outer surface 36 of the lower portion of each clamping piece in front of a respective one of the radial bores 20. To tighten the clamping pieces against the rod, bolts threaded in the threaded radial bores 20 of the housing 12 are rotated in an advancing direction via use of a wrench, socket or other suitable torquing tool on the bolt heads located outside the housing so as to advance the free ends of the bolt shafts radially inward from the boundary wall of the housing through-bore 16, thereby driving the free ends of the bolts against the outer surfaces of the clamping pieces 24, thereby using the free shaft-end of each bolt as a working end to drive the arcuate inner surface of the respective clamping piece against the rod.

In addition to the use of bolts as mechanisms to actuate a tightening effect of the clamping pieces on the rod, the clamping pieces also act as automatically tightening slips under contact of their externally beveled lower ends 38 with the internally beveled intermediate portion 16*c* of the housing 12, which tapers at the same angle as the lower ends of the clamping pieces. That is, the beveled surfaces cooperate to force the clamping pieces radially inward toward the longitudinal axis of the housing 12, thereby tightening the clamping pieces against the circumference of the rod passing through the housing. The axial length of the clamping pieces are such that their bottom ends will reach the internal beveled surface 16*c* of the housing 12 before the shoulder 28*a* of the enlarged upper portions 28 of the clamping pieces reach the flat top end of the housing 12. Accordingly, the slip type tightening action of the beveled surfaces will initiate before downward movement of the clamping pieces is eventually stopped, by one or both of contact of the external shoulders of the clamping pieces with the top end of the housing or wedging of the clamping pieces between the rod and the housing bevel 16*c* to the point where no further downward movement is possible. At this stopping point where further downward motion of the clamping pieces is blocked, in view of the tight clamping of the clamping pieces to the rod, downward motion of the rod is also blocked, thus hanging or suspending the rod string from the housing.

The clamping device 10 can be employed in the above manner during removal and disassembly of a rod string. With an upper rod of the string supported above surface by a rod elevator, a second rod situated down the string from the upper rod and passing through the rotary table is engaged by the rod clamping device to suspend the remainder of the string below the second rod from the device housing seated atop the table. The clamping device thus supports the rod string while the upper rod is removed, and while the same elevator previously suspending the rod string from the now-removed uppermost rod is transferred down the string to the second highest rod, where the elevator is then latched to this rod. With the remainder of the rod string now once again supported by the elevator, the clamping pieces of the clamping device are loosened from the second rod by loosening the clamping bolts that pass radially through the housing wall. The rod string is raised up by the elevator, pulling the second rod up from out of the loosened clamping pieces and surrounding housing, and the clamping pieces of the device are retightened against the rod at a third rod disposed immediately below the second through re-tightening of the clamping bolts to once again suspend the remainder of the rod string in the wellbore from the table-seated clamping device housing thereabove. The now-highest rod, formerly the second highest, can now be removed while the remainder of the string hangs from the clamping device. This process is repeated to continue to the dismantling of the rod string. When no further suspension of the rod by the device is required, the clamping piece assembly can be lifted from out of the housing and swiveled open to withdraw from around the remaining lower portion of the string, and the housing can be withdrawn from its position around the rotary table opening above the wellbore by displacing the housing laterally out of its working position around the string, thereby relatively moving the string out from the housing's passageway via the circumferential gap in its wall structure.

While the illustrated embodiment employs beveled lower ends of the clamping pieces and a corresponding internal bevel at a lower position on the housing to provide a slip-type clamping action under a predetermined amount of lowering of the clamping pieces from their initial entry in the top end of the housing, other embodiments may forgo such an auxiliary clamp-tightening action, and instead rely solely on the bolt-type tightening mechanism further up the housing wall to achieve sufficient clamping force against the rod string, and rely on the abutment of the external shoulders of the clamping pieces against the top of the housing to define the stop-feature at which this contact of non-vertical surfaces between the housing and the clamping pieces acts to hang the clamping pieces, and the rod string to which they are clamped, from the housing. However, the use of the bevels to provide an automatic, secondary clamping action avoids falling of the rod string under insufficient tightening of the user-operated bolt-based tightening mechanism.

Having the bolts define an operator-controlled mechanism arranged to drive a tightening action of the clamping pieces toward the central longitudinal axis of the passageway in the housing allows clamping assemblies of different sizes for different diameter rods to be used with the same housing. With reference to FIG. 1, different clamping piece assemblies of varying outer dimensions smaller than the upper portion 16*a* of the housing can be selectively received therein, as the tightening mechanism provided by the bolts on the housing can use to compensate for any annular space left between the clamping pieces and the surrounding housing wall and tighten the pieces against the rod string. It will be appreciated that while three clamping pieces and three corresponding bolt-holes 20 in the housing are shown and described, the number of multiple clamping pieces may be to as few as two, or upwards of three, with at least as many bolt-holes for tightening of all the clamping pieces against the rod string.

FIG. 7 shows a second embodiment housing 12' in which the wall structure 14' shares most of features of the first embodiment, including the same gap-leaving c-shaped configuration, partially beveled interior, and radially bores for the clamp tightening bolts. However, the second embodiment differs in that the exterior of the wall structure 14' features enlarged upper and lower portions 48, 50 of greater diameter than an intermediate reduced portion 52. The larger upper portion 48 defines a downward facing shoulder 48*a* at the transition to the intermediate portion 52 for seating atop an upward facing surface of the tubing elevator at a position above where the elevator is latched closed around the intermediate portion of the housing, and the larger lower portion 50 defines an upward facing shoulder 50*a* at the transition to the intermediate portion 52 for catching beneath a downward facing surface of the elevator at a position below where the elevator is latched closed around the intermediate portion of the housing. The intermediate portion has an outer diameter suitable for gripping by the tubing elevator when the elevator is latched closed around it. Accordingly, the device of the present invention can be used to allow a tubing elevator to grip a rod string, whereas the elevator on its own is incapable of such function due to its design for use with tubing or casing of notably greater diameter than the rod string When the housing 12' is gripped by the elevator, the shouldered upper portion 48 blocks downward sliding of the housing from out of the mouth of the elevator, while the shouldered lower portion 50 blocks upward sliding of the housing from out of the mouth of the elevator. The bolt holes 20 are located in the enlarged upper portion of the housing so as to remain accessible above the latching mechanism in the mouth of the elevator when the intermediate portion is gripped therein. The interior of the housing is dimensioned to receive clamping pieces of the type described above, which are dimensioned to clamp on rods of smaller diameter than the tubing or casing for which the elevator has been designed. The second embodiment clamping device therefore defines an auxiliary attachment for adapting a tubing elevator for support of a rod string of smaller outer diameter than for which the elevator is otherwise capable of gripping. This way, the clamping device can be used, for example, to pull out a rod string that has become stuck in the wellbore, by using the greater amount of pull achievable with the tubing or casing elevator than by use of a conventional rod elevator, as tubing elevators are designed for greater weight capacity of casing or tubing strings relative to smaller rod strings.

The shouldered lower portion 50 of the second embodiment may also be advantageous in the context described for the first embodiment, as the enlarged lower portion 50 increases the outer diameter of the housing, thereby increasing the effective footprint of the housing to provide improved resistance to tilting or tipping over thereof. That is, the enlarged lower portion increases the outer size of the preferably flat bottom end of the housing to provide a more stable base for the device. Accordingly, housings may be produced in accordance with the shape of the second embodiment to allow use of the clamping device in either elevator-carried or other contexts.

Figure 8A:
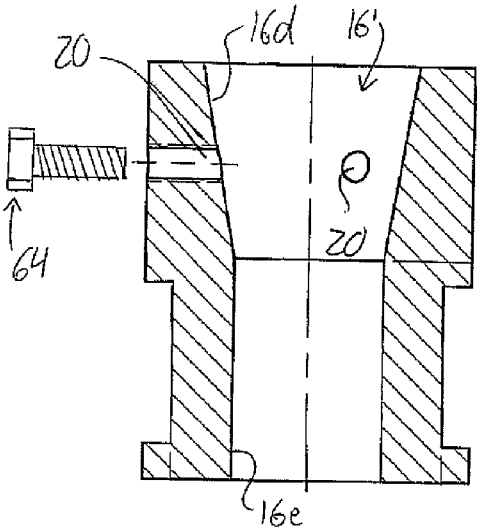
FIG. 8A is an axial cross-sectional view of the housing of FIG. 8.
Figure 8:
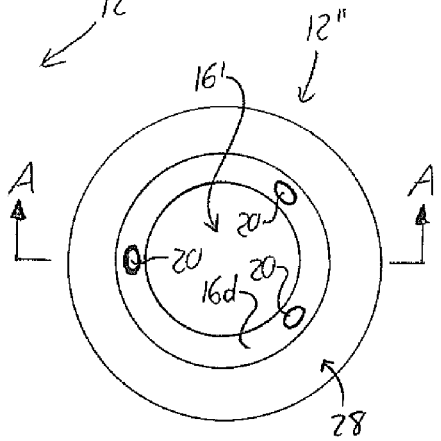
FIG. 8 is an overhead plan view of a housing of a third embodiment clamping device.
Figure 9:
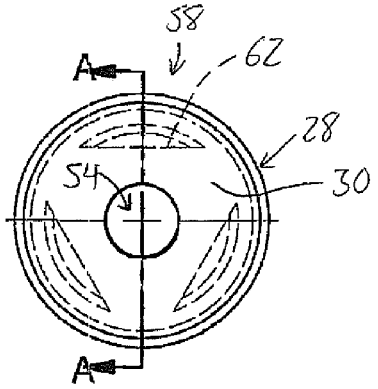
FIG. 9 is an overhead plan view of a body from which the clamping pieces of the third embodiment clamping device are cut during manufacture thereof.
Figure 9A:
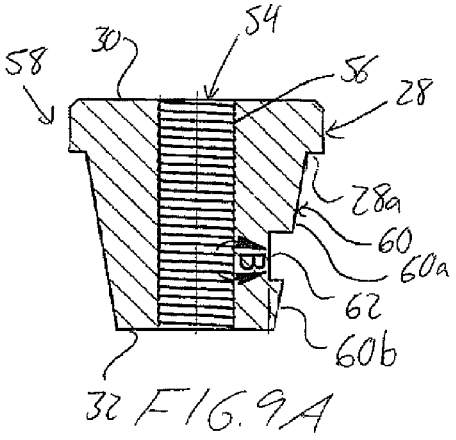
FIG. 9A is an axial cross-sectional view of the body of FIG. 9 as taken along line A-A thereof.
Figure 9B:
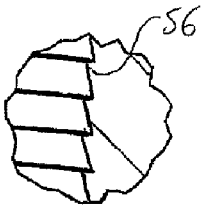
FIG. 9B is a detailed close-up view of a portion of the body of FIG. 9A as marked at area B thereof.

FIGS. 8 and 9 illustrate a third embodiment clamping device that operates similar to that of the second embodiment to allow use with a tubular elevator, but some modifications. FIG. 8 illustrates the housing 12" of the device, and FIG. 9 illustrates a body of stock material 58 that has been machined into an annular form having cylindrical and frustoconical external surfaces lying concentric with a cylindrical axial through-bore 54 having thread-like helical teeth 56. The clamping pieces are then cut from this body by dividing the same into three-equal segments by cutting axially through the annular body at three radial positions equally spaced around the circumference thereof.

With reference to FIG. 9, unlike the first and second embodiment clamping pieces where only a lowermost portion each clamping piece is externally beveled by a frustoconically contoured surface 60 sloping inward, the third embodiment is beveled to frustoconically slope inward directly from the shoulder 28*a* defined at the underside of the enlarged upper end portion 28. At an intermediate location along the height of the beveled portion of its exterior, each clamping piece features a rectangular flat 62 that runs across a substantial majority of the arcuate span of the segment-shaped clamping. This flat 62 lies at a radial position that is set inward from the intact frusto-conically contoured areas 60*a*, 60*b* of the outer surface 60 above and below the flat 62, and lies in a plane that is tangential to the axis of the clamping piece at the center of the piece's circumferential span about that axis.

With reference to FIG. 8, the housing 12" of the third embodiment differs from that of the second embodiment in that the through bore 16' is not configured with a beveled intermediate portion disposed at an elevation between upper and lower cylindrical portions, but rather features a beveled upper portion 16*d* that frustoconically tapers downward from the top end of the housing 12", and a cylindrical lower portion 16*e* that over the remainder of the housing from the bottom end of the beveled upper portion 16*d* down to the bottom end of the housing 12". The axial length of the beveled upper portion 16*d* of the housing through bore 16' slightly exceeds the axial length of the beveled portion of each clamping piece (i.e. the axial distance from the shoulder 28*a* of the clamping piece to the bottom end thereof). The bevel angle of the clamping pieces match the bevel angle of the upper portion of the housing bore so that the gripping action of the clamping pieces is increased by the weight of the rod string as described above.

The housing 12" of the third embodiment also differs from the first two embodiments, in that there is no gap or break in the circumference of the housing. That is, the housing features a full annular wall closing 360-degrees around the central bore 16' of the housing. This provides greater strength and structural integrity for safe use of the clamping device on a tubular elevator for exerting the significant pulling force that may be required to release a rod string that has become stuck in the well. Accordingly, the first two embodiments may be better suited for hanging applications where the drill string is just being suspended by the clamping device, while the third embodiment provides a more robust solution for overpull operations, where the device needs to be able to apply a force that exceeds the weight of the rod string alone. Without the gap that allows sliding of the housing into a position spanning substantially around the rod string, the third embodiment requires that the housing be placed around the rod string by lowering the housing over the upper end thereof. Accordingly, the housing is latched in place in the elevator, and the elevator is used to slide the housing down over the upper end of the rod string. The process for pulling the string then follows that described above for the second embodiment.

In the third embodiment, having the clamping pieces beveled over a substantial majority of their axial length and having a beveled portion of the housing bore that covers the full axial length of the beveled portion of each clamping piece maximizes the area over which the clamping effect is achieved on the rod circumference. The flats 62 of the clamping pieces are positioned at a distance below the shoulders 28*a* of the clamping pieces that corresponds to the distance at which the threaded bores 20 of the housing 12" are positioned below the top end of the housing 12". This way, bolts 64 threaded into the housing's central bore 16' to tighten the clamping pieces against the rod act against the flats 62 of the clamping pieces to better hold the clamping pieces in place.

Figure 10:
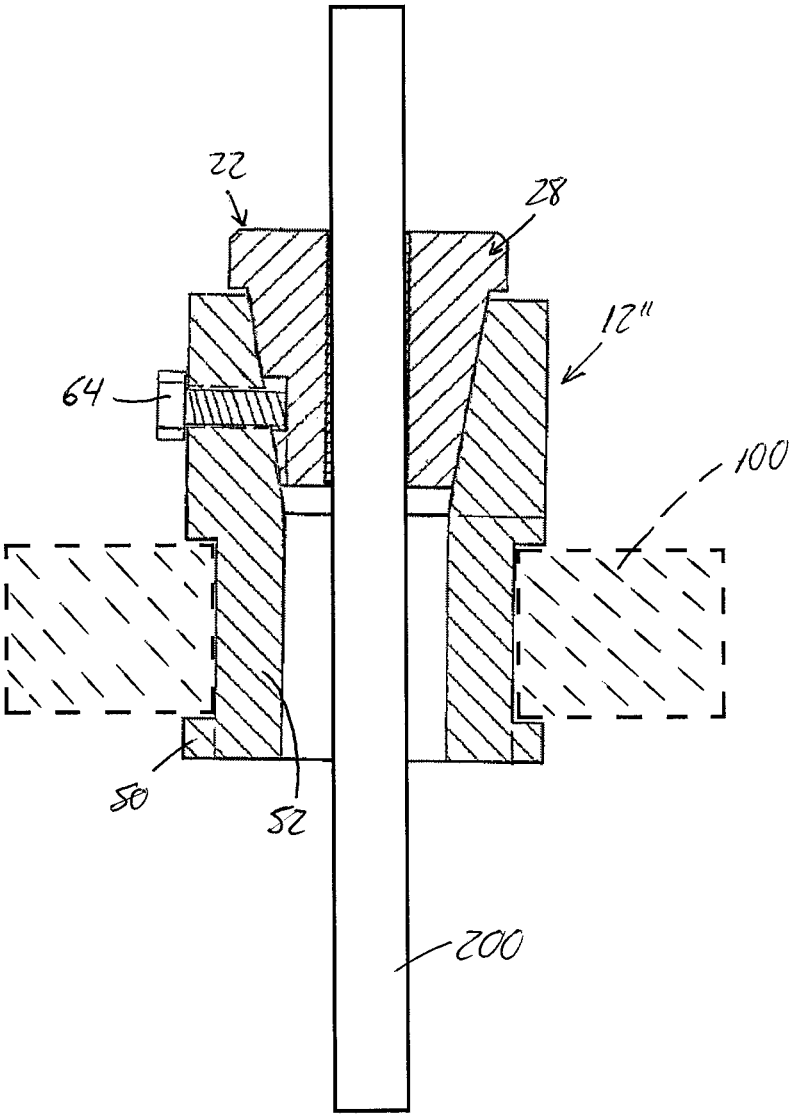
FIG. 10 schematically illustrates use of the third embodiment clamping device to enable gripping of a rod string using a tubing elevator that was originally intended for larger diameter tubulars and therefore is not directly compatible with smaller diameter rods.

FIG. 10 schematically illustrates use of the third embodiment clamping device with a conventional tubing elevator, shown schematically without detail in broken lines at 100. The tubing elevator 100 latches around the housing's reduced-diameter intermediate portion 52, and the clamping pieces of the clamping device grip a rod string 200 whose diameter is too small for direct gripping thereof by the elevator that was designed for use on larger well tubulars. As described above, the clamping device thereby enables use of the tubing elevator to manipulate the smaller diameter rod string.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A rod clamping device for suspending a rod within a wellbore from a surface position above said wellbore, the device comprising:

an outer housing having an axial passageway extending therethrough along a primary longitudinal axis, the housing comprising a wall structure extending circumferentially about the longitudinal axis but spanning less than fully therearound to leave a gap for accessing the axial passageway from outside the wall structure;

a plurality of clamping pieces each comprising a clamping portion having an arcuately contoured inner face curving about a respective secondary longitudinal axis, the arcuately contoured inner faces of the clamping pieces being configured with the same arcuate contour about the respective secondary longitudinal axes so that coincident positioning of said respective secondary longitudinal axes with one another positions the arcuately contoured inner faces of the clamping pieces on a shared circular path around said coincident axes and positions the clamping portions of the clamping pieces in a configuration sized to fit within the axial passageway of the outer housing;

a plurality of clamping actuators on the outer housing, each clamping actuator having a respective working end that is disposed within the axial passageway and exposed to contact with a respective one of the clamping pieces at an outer surface thereof when the clamping portions of the clamping pieces are received in the axial passageway, and each clamping actuator being operable to move the respective working end toward the primary longitudinal axis in contact with the outer surface of the respective one of the clamping pieces so as to force the respective one of the clamping pieces toward the primary longitudinal axis of the axial passageway of the housing when the clamping portions of the clamping pieces are received therein; and stop features, comprising an outer housing portion on the outer housing and a clamping piece portion on each of the plurality of clamping pieces, arranged to block sliding of the clamping pieces fully through a lower end of the axial passageway of the housing.

2. The clamping device of claim 1 wherein the clamping piece portion of the stop features comprises externally beveled portions of the clamping pieces and the outer housing portion of the stop features comprises an internally beveled portion of the axial passage, the externally beveled portions of the clamping pieces and the internally beveled portion of the housing being beveled at equal angles.

3. The clamping device of claim 1 wherein the clamping piece portion of the stop features comprises external shoulders projecting outward from the clamping pieces to rest atop the housing at positions around the axial passageway therein.

4. The clamping device of claim 1 comprising a pivotal connection respectively defined between at least one pair of adjacent clamping pieces by a nut and bolt fastener in a less than fully tightened state that secures the adjacent clamping pieces together while allowing pivoting therebetween about a pivot axis that is defined by said nut and bolt fastener, and is oriented transverse to the secondary longitudinal axes of said respective pair of clamping pieces.

5. The clamping device of claim 4 comprising three of said clamping pieces, each of said three clamping pieces being connected to the two other clamping pieces by a respective one of said pivotal connection.

6. The clamping device of claim 1 wherein the clamping actuators comprise threaded members engaged in threaded bores extending through the wall structure of the housing.

7. The clamping device claim 6 wherein the threaded members comprise drive heads engagable by an external tool separate from the clamping device at locations outside the housing.

8. The clamping device claim 1 wherein the housing comprises a lower base defining a greater outer radius of said housing from the primary longitudinal axis at a bottom end thereof than above said base.

9. The clamping device of claim 1 wherein the housing comprises a shouldered upper portion of greater outer radius from the primary longitudinal axis than an intermediate portion of the housing disposed below the shouldered upper portion.

10. The clamping device of claim 9 in combination with a tubing elevator and a small diameter rod having an outer diameter too small for direct gripping by said tubing elevator, wherein the intermediate portion of the housing is latched in the tubing elevator, the shouldered upper portion of the outer housing of the clamping device blocks falling thereof from the tubing elevator, and the small diameter rod is gripped by the clamping members, whereby the clamping device enables manipulation of the small diameter rod by the tubing elevator.

11. The clamping device of claim 1 wherein the housing comprises a flat bottom for seating the housing atop a support structure situated over the wellbore.

12. The clamping device of claim 1 wherein the clamping pieces are separate from the housing for manual placement in the axial passage of the housing after placement of the housing around the rod.

13. The clamping device of claim 1 comprising multiple sets of said clamping pieces, each set being differently sized to engage rods of a respective diameter.

14. A method of using the clamping device of claim 1 to support a rod string depending into the wellbore through a structure disposed thereover, the method comprising the following steps:

(a) with the rod string carried independently of the clamping device, displacing the housing toward the rod string to receive the rod string within the axial passageway of the housing through the gap in the wall structure thereof to seat the housing on the structure in a position extending about the rod string;

(b) placing the clamping pieces within the axial passageway of the housing in an annular space left between the rod string and the wall structure of the housing with the arcuately contoured inner faces of the clamping pieces facing toward the rod string; and (c) operating the clamping actuators to drive the respective working end of each clamping actuator toward the longitudinal axis in contact against the outer surface of the respective clamping piece to urge the clamping pieces into clamped conditions against the rod string;

(d) engaging together the stop features of the housing and the clamping pieces to seat the clamping pieces on the housing to suspend the rod string therefrom.

15. The method of claim 14 further comprising step (e) of releasing the other supporting means from the rod string, removing an uppermost rod from the string, engaging the other supporting means to the another rod of the rod string at a location below where the uppermost rod was removed and above the clamping pieces, loosening the clamping action of the clamping pieces on said other rod, lifting the rod string using the other supporting means, and repeating steps (c) through (e) to continue dismantling the rod string.

16. In combination, a tubing elevator, a small diameter rod having an outer diameter too small for direct gripping by said tubing elevator, and an auxiliary clamping device for pulling said small diameter from a wellbore with said tubing elevator, said clamping device comprising:

an outer housing having an axial passageway extending therethrough along a primary longitudinal axis, the housing comprising a wall structure extending about the primary longitudinal axis but spanning less than fully therearound to leave a gap for accessing the axial passageway from outside the wall structure, the outer housing having an outer diameter in latched engagement with the tubing elevator;

a plurality of clamping pieces each comprising a clamping portion having an arcuately contoured inner face curving about a respective secondary longitudinal axis, the arcuately contoured inner faces of the clamping pieces being configured with the same arcuate contour about the respective secondary longitudinal axes so that coincident positioning of said respective secondary longitudinal axes with one another positions the arcuately contoured inner faces of the clamping pieces on a shared circular path around said coincident axes and positions the clamping portions of the clamping pieces in a configuration sized to fit within the axial passageway of the outer housing in circumferential relation around the rod;

a mechanism operable to displace the clamping pieces toward the longitudinal axis of the axial passage of the housing when said clamping pieces are received therein to grip the rod between the clamping pieces; and a first set stop features, comprising an outer housing portion on the outer housing and a clamping piece portion on each of the plurality of clamping pieces, arranged to block sliding of the clamping pieces fully through a lower end of the axial passageway of the housing; and a second stop feature provided on the outer housing and arranged to retain the outer housing in the latched engagement by the tubing elevator, whereby the clamping device enables carrying of the small diameter rod on the tubing elevator for manipulation of the small diameter rod with said tubing elevator.

17. The combination of claim 16 wherein the second stop feature comprises a shouldered upper portion of greater radial outer radius from the primary longitudinal axis than an intermediate portion of the housing around which the tubing elevator is latched, and the shouldered upper portion rests on the tubing elevator to block sliding of the housing downward through the tubing elevator.

18. The combination of claim 16 wherein the housing comprises a shouldered lower portion defining a greater outer radius from the primary longitudinal axis than defined by said housing at an area thereof at which the elevator latches around said housing above said shouldered lower portion, and the shouldered lower portion catches under the tubing elevator to block sliding of the housing upward through the tubing elevator.

19. The combination of claim 16 wherein the clamping pieces have beveled outer surfaces cooperable with beveled inner surfaces of the wall structure of the housing to automatically bias the clamping pieces toward the primary longitudinal axis of the axial passageway of the housing when received therein.

20. A method of using the combination of claim 16 to pull a rod string, comprising:

situating the housing in a condition in which a rod of the rod string passes through the axial passageway of the housing and the elevator is latched around the housing;

with the clamping pieces positioned in an annular space between the rod and the wall structure of the housing, clamping the clamping pieces against the rod, and engaging together the first step of stop features between the housing and the clamping pieces to seat the clamping pieces on the housing to suspend the rod string therefrom; and using the elevator to raise the housing, thereby pulling the clamped-together rod and clamping pieces to pull the rod string.

* * * * *